US011992125B2

(12) United States Patent
Murphy

(10) Patent No.: US 11,992,125 B2
(45) Date of Patent: May 28, 2024

(54) RECLINING SEATING UNIT WITH RECIPROCATING CAPABILITY

(71) Applicant: Ultra-Mek, Inc., Denton, NC (US)

(72) Inventor: Marcus L. Murphy, Lexington, NC (US)

(73) Assignee: ULTRA-MEK, INC., Denton, NC (US)

( * ) Notice: Subject to any disclaimer, the term of this patent is extended or adjusted under 35 U.S.C. 154(b) by 48 days.

(21) Appl. No.: 17/733,012

(22) Filed: Apr. 29, 2022

(65) Prior Publication Data

US 2022/0400863 A1 Dec. 22, 2022

Related U.S. Application Data

(60) Provisional application No. 63/212,277, filed on Jun. 18, 2021.

(51) Int. Cl.

| | |
|---|---|
| ***A47C 1/024*** | (2006.01) |
| ***A47C 1/0355*** | (2013.01) |
| ***A47C 3/02*** | (2006.01) |
| ***A47C 3/025*** | (2006.01) |

(52) U.S. Cl.

CPC ..... *A47C 1/0242* (2013.01); *A47C 1/0355* (2013.01); *A47C 3/0251* (2018.08); *A47C 3/0257* (2013.01)

(58) Field of Classification Search

CPC ... A47C 1/0242; A47C 3/0251; A47C 3/0257; A47C 1/03211; A47C 3/0255; A47C 1/0307; A47C 1/0355

USPC ..... 297/260.2, 315, 316, 330, 362.11

See application file for complete search history.

(56) References Cited

U.S. PATENT DOCUMENTS

| | | | | |
|---|---|---|---|---|
| 3,758,151 | A * | 9/1973 | Re | A47C 1/0345 297/383 |
| 4,202,580 | A * | 5/1980 | Johnson | A47C 1/034 297/68 |
| 4,519,647 | A | 5/1985 | Rogers | |
| 4,616,874 | A * | 10/1986 | Pietsch | B60N 2/1842 297/343 |
| 5,280,996 | A | 1/1994 | Trent | |
| 6,033,020 | A * | 3/2000 | Ito | A47C 7/444 297/328 |
| 8,113,574 | B2 * | 2/2012 | Hoffman | A47C 3/18 297/85 L |
| 8,911,009 | B2 * | 12/2014 | Hoffman | A47C 1/03272 297/75 |

(Continued)

*Primary Examiner* — Robert Canfield

(74) *Attorney, Agent, or Firm* — Myers Bigel, P.A.

(57) ABSTRACT

A reciprocating seating unit includes: a base; a frame including a generally horizontal seat and opposed arms; a backrest; a reciprocating unit attached to the base, the reciprocating unit configured to permit reciprocating longitudinal movement of the frame and backrest relative to the base; and a reclining mechanism attached to the reciprocating unit, the frame and the backrest. The reclining mechanism includes pivotally interconnected links and is configured to move the backrest between an upright position, wherein the backrest takes a first backrest angle relative to the underlying surface and the frame is positioned relative to the base in a first location, and a reclining position, wherein the backrest takes a second backrest angle that is shallower than the first backrest angle, and the frame is positioned relative to the base in a second location that is at least 3 inches in front of the first location.

14 Claims, 16 Drawing Sheets

(56) References Cited

U.S. PATENT DOCUMENTS

| | | | | |
|---|---|---|---|---|
| 9,603,452 | B2 * | 3/2017 | Murphy | A47C 1/0347 |
| 10,292,501 | B1 * | 5/2019 | Brown | A47C 7/506 |
| 2009/0243368 | A1 * | 10/2009 | LaPointe | A47C 1/0355 297/259.1 |
| 2012/0112517 | A1 * | 5/2012 | Hoffman | A47C 1/0355 297/85 L |
| 2012/0112519 | A1 * | 5/2012 | Murphy | A47C 1/0355 297/85 M |
| 2012/0146364 | A1 * | 6/2012 | Hoffman | A47C 1/03266 297/84 |
| 2018/0027967 | A1 * | 2/2018 | Lawson | A47C 1/0355 |
| 2018/0228290 | A1 * | 8/2018 | Kiwak | A47C 1/03211 |

* cited by examiner

RECLINING SEATING UNIT WITH RECIPROCATING CAPABILITY

RELATED APPLICATION

The present application claims priority from and the benefit of U.S. Provisional Patent Application No. 63/212,277, filed Jun. 18, 2021, the disclosure of which is hereby incorporated herein by reference in full.

FIELD OF THE INVENTION

The present invention relates generally to seating units, and more particularly to reclining seating units.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

Also, for many years, rocking chairs have been popular furniture pieces in the home. The repetitive rocking motion of the chair can be quite relaxing and comforting to a seated occupant. In addition, the appearance of the rocking chair can allow it to be used with a variety of furniture styles, particularly traditional styles with a heavy emphasis on visible wood.

One particularly popular chair is the so-called "rocker-recliner," which can, when in the upright position, rock with a forward and rearward motion similar to that of a traditional rocking chair. A typical rocker recliner, one of which is illustrated in U.S. Pat. No. 4,519,647 to Rogers, includes an arcuate rocker cam that is attached with the lower portion of each mechanism, with the lower convex surface of the rocker cam contacting a level bearing surface of the base. Also, a spring assembly is mounted to the base of the chair and to each rocker cam. Each spring assembly includes two quite stiff, vertically-oriented helical springs attached to mounting brackets that are in turn fixed to the base and to the rocker cam. When the chair is in its upright position and is unoccupied, the seat, backrest and reclining mechanisms reside above the base, the rocker springs are deflected only along their longitudinal axes, and the rocker cams rest on a level portion of the base. When an occupant sits on the chair and applies a forwardly- or rearwardly-directed force to the seat or backrest, the seat and backrest move relative to the base. The path of movement is defined by the convex shape of the rocker cams as they rock on the level bearing surface of the base, with the result that the seat and backrest simulate the rocking motion of a rocking chair. During the rocking movement, the rocker springs deflect such that their top portions bend away from their longitudinal axes as the chair rocks forward and back. The deflection in the springs urges the springs (and, in turn, the seat and backrest) to return to their original positions as the chair returns to and through the upright position. In this manner, the chair is capable of providing a controlled rocking motion when in the upright position. Another rocking mechanism is shown in U.S. Pat. No. 8,911,009 to Hoffman et al., which utilizes two pivoting members biased by a spring to provide a rocking motion.

In recent years, furniture designers have looked for alternatives to rocking chairs that can provide a similarly relaxing repetitive motion. One alternative has been the gliding chair, or "glider", which includes components that enable the seat portion of the chair to "glide" forwardly and rearwardly relative to its base to mimic generally the rocking motion of a rocking chair. Often the gliding structure comprises a set of swing links (usually two at the front of the chair, and two at the rear) that are pivotally attached at their upper ends to the base and extend downwardly therefrom to attach to a mounting structure, such as a bracket, that is attached to the seat. In this configuration, the seat is suspended from the base and is free to swing forwardly and rearwardly in a double pendulum-type motion in response to a forwardly or rearwardly-directed force applied by a seated occupant. The gliding path of the chair is controlled by the configuration and mounting of the swing links. These chairs can be constructed to resemble traditional rocking chairs on appearance and thus are quite popular. One example of such a glider is illustrated and described in U.S. Pat. No. 5,280,996 to Trent. Another exemplary glider is shown in U.S. Pat. No. 9,603,452 to Murphy et al.

Given the popularity of these different types of chairs, it may be desirable to provide alternative configurations.

SUMMARY OF THE INVENTION

As a first aspect, embodiments of the invention are directed to a reciprocating seating unit. The seating unit comprises: a base configured to rest on an underlying surface; a frame comprising a generally horizontal seat and opposed arms on opposite sides of the seat; a backrest; a reciprocating unit attached to the base, the reciprocating unit configured to permit reciprocating longitudinal movement of the frame and backrest relative to the base; and a reclining mechanism attached to the reciprocating unit, the frame and the backrest. The reclining mechanism comprises a plurality of pivotally interconnected links and is configured to move the backrest between an upright position, in which the backrest takes a first backrest angle relative to the underlying surface and the frame is positioned relative to the base in a first location, and a reclining position, in which the backrest takes a second backrest angle relative to the underlying surface that is shallower than the first backrest angle, and the frame is positioned relative to the base in a second location that is at least 3 inches in front of the first location.

As a second aspect, embodiments of the invention are directed to a seating unit as described above, wherein the reciprocating unit is a gliding unit.

As a third aspect, embodiments of the invention are directed to a seating unit as described above, wherein the reciprocating unit is a rocking unit.

DETAILED DESCRIPTION OF THE INVENTION

Figure 1:
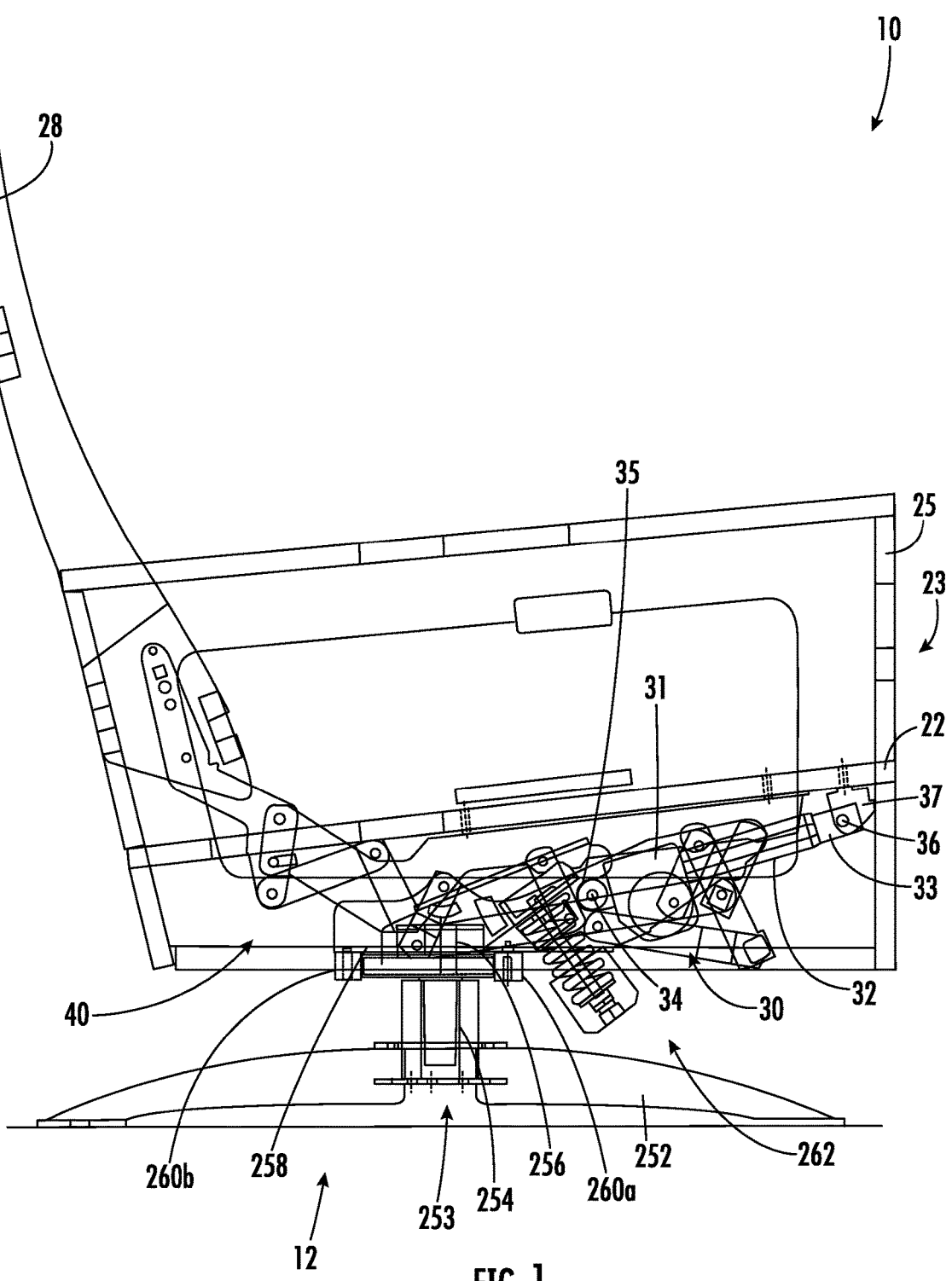
FIG. 1 is a side section view of a rocking-reclining chair according to embodiments of the invention, with the chair shown in the upright position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like members refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on". "attached" to "connected" to, "coupled" with, "contacting", etc., another element, it can be directly on, attached to, connected to, coupled with or contacting the other element or intervening elements may also be present. In contrast, when an element is referred to as being, for example. "directly on", "directly attached" to. "directly connected" to. "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a stationary base, a seat portion, and a backrest. As used herein, the terms "forward". "forwardly", and "front" and derivatives thereof refer to the direction defined by a vector extending from the backrest toward the seat parallel to the underlying surface. Conversely, the terms "rearward". "rearwardly", and derivatives thereof refer to the direction directly opposite the forward direction, the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial." "inward." "inboard," and derivatives thereof refer to the direction that is the converse of the lateral direction. i.e., the direction parallel with the floor, perpendicular to the forward direction, and extending from the periphery of the seating units toward the aforementioned bisecting plane.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the drawings, a chair, designated broadly at 10, is illustrated in FIGS. 1-6. The chair 10 includes a base 12, arms 25 that are fixed to a seat 22 to form a frame 23, and a backrest 28. These components identified above are described in greater detail below. As used herein to describe the relative positions of components, the terms "lateral". "outward" and derivatives thereof indicate the directions defined by a vector beginning at a vertical plane P (shown in FIG. 6) that bisects the chair 10 normal to the seat 22 and the backrest 28 and extending normal thereto (i.e., from the center of the chair 10 toward the arms). Conversely, the terms "inward". "inboard" and derivatives thereof indicate the direction opposite the "outward" direction. Together, the "inward" and "outward" directions comprise the "transverse" axis of the chair 10. The "rear" of the chair 10 is located at the tip of the backrest 28, and the "front" of the chair 10 is located at the end of the seat 22 farthest from the backrest 28. The "front" and "rear" directions comprise the "longitudinal" axis of the chair 10.

Figure 2:
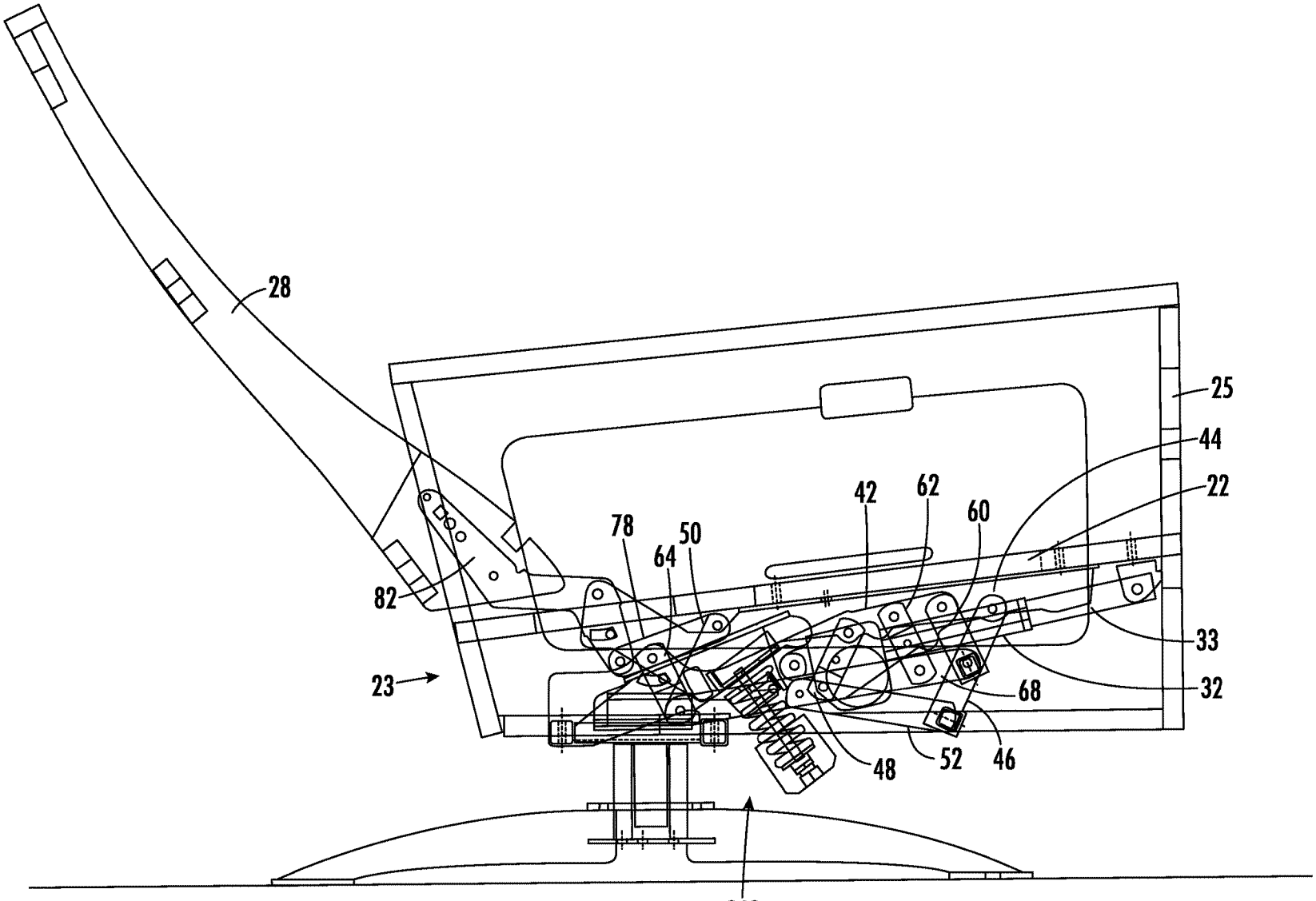
FIG. 2 is a side section view of the chair of FIG. 1, with the chair shown in the reclined position.
Figure 6:
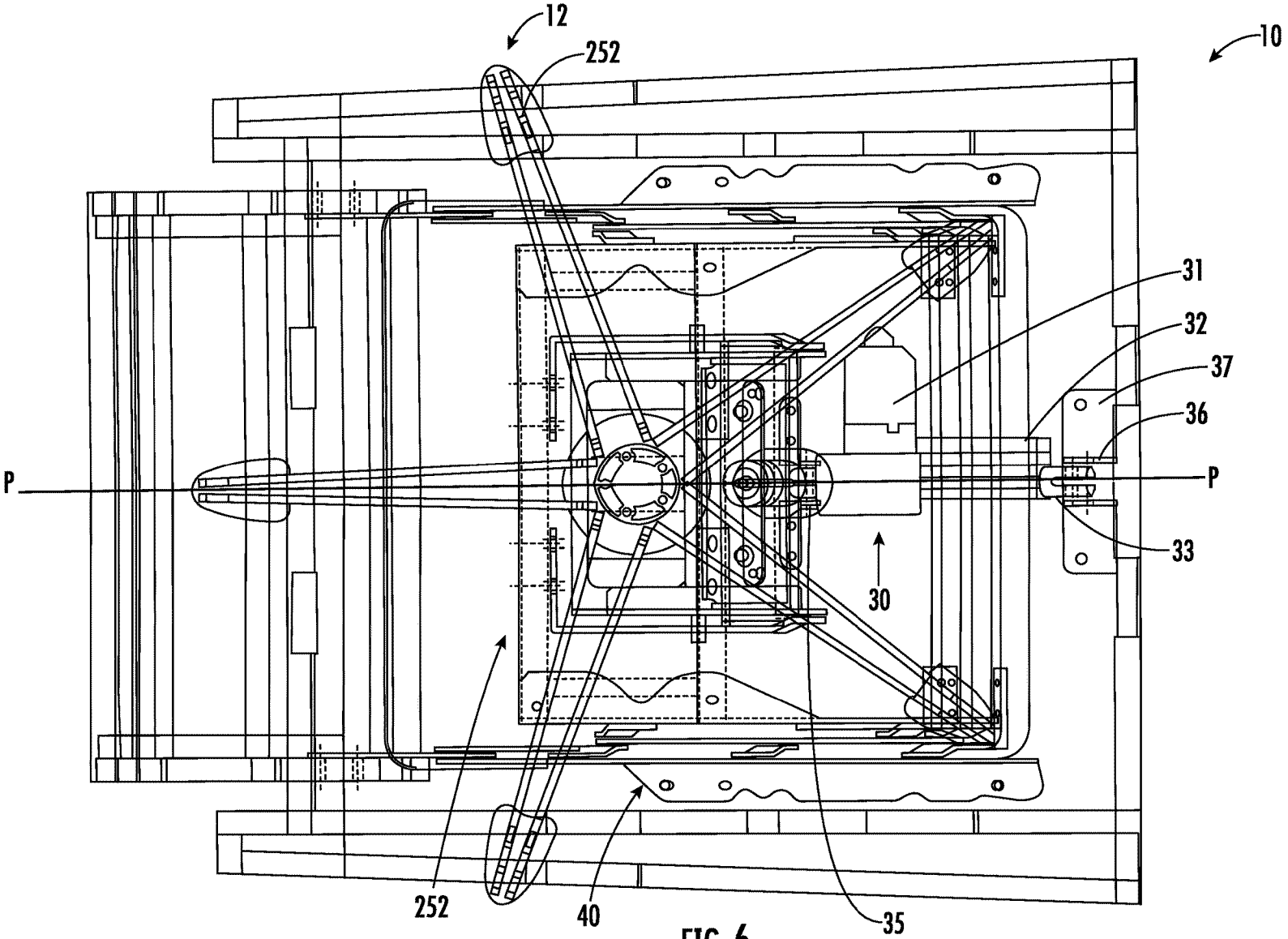
FIG. 6 is a top section view of the chair of FIG. 1.

Referring to FIGS. 2 and 6, the base 12 includes a circular, spoked foundation 252. A swivel unit 253 includes a sleeve 254 within which is rotatably mounted a spindle 256. A tabbed plate 258 is fixed to the upper end of the spindle 256.

Figure 3:
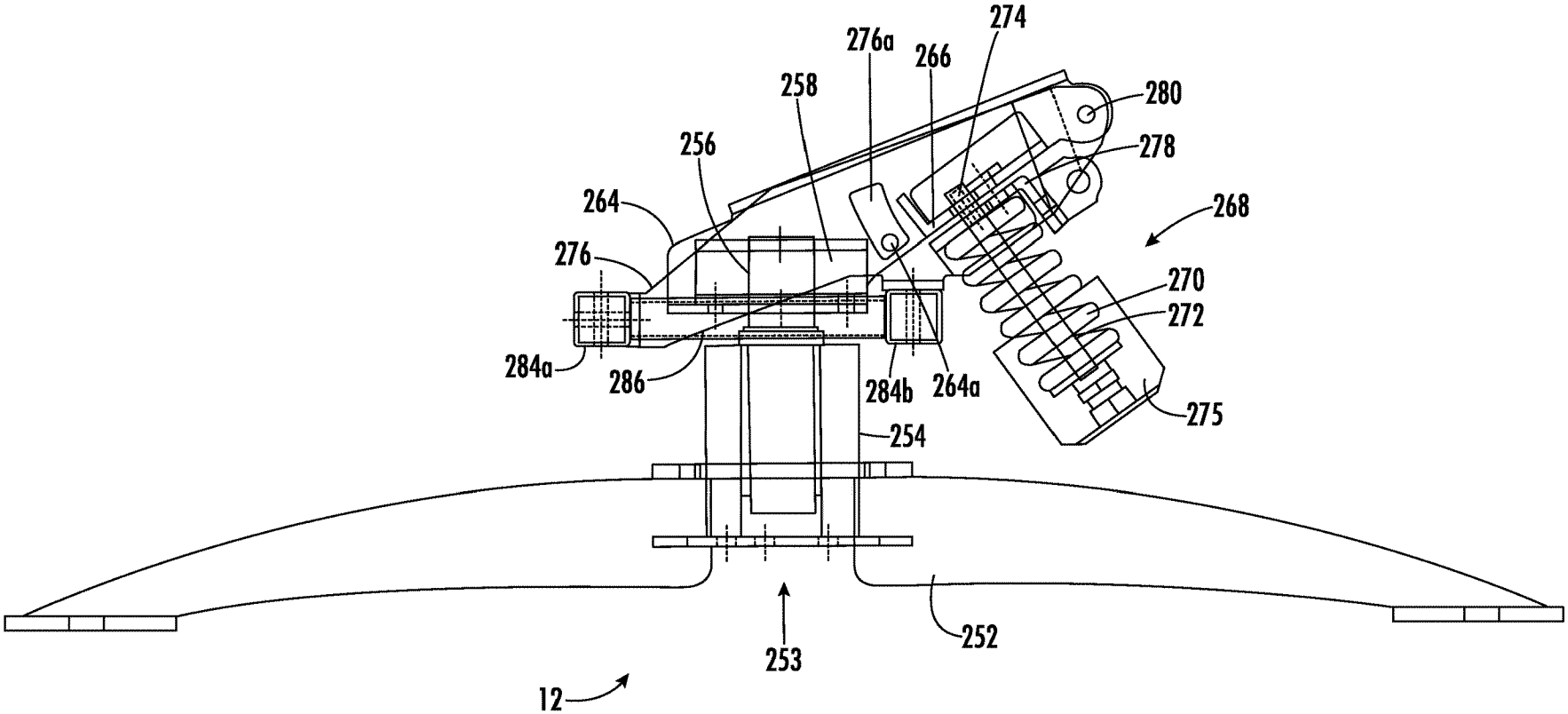
FIG. 3 is a side view of the base and the rocker assembly of FIG. 1.

Referring still to FIG. 2 and also to FIG. 3, a rocker assembly 262 includes a mounting bracket 264 fixed at each lateral end of the tabbed plate 258. A cross-member 266 spans the mounting brackets 264. A rocking link 276 is mounted at a pivot 280 to each mounting bracket 264. The pivot 280 is positioned well forward of the spindle 256 of the swivel unit 253, typically between about 3 and 7.5 inches from the front of the seat 22. A spring base 278 spans the front portions of the rocking links 276. Cross-members 284*a*, 284*b* span the front and rear portions of the rocking links 276. The cross members 284*a*, 284*b* are supported by braces 286. A pin 264*a* mounted to the mounting bracket 264 extends through an arcuate slot 276*a* in the rocking link 276.

A spring unit 268 includes a helical spring 270 and a spring rod 272. The spring rod 272, which passes through the coils of the spring 270, is mounted at one end to a cap 275, which is threaded onto the spring rod 272, and at its other end to the spring base 278 at a pivot 274.

Notably, the rocker assembly 262 is relatively short in height, which can enable it to be used with multiple chair styles. In some embodiments, the height of the rocker assembly 262, measured from its lowermost portion (in this case the lower end of the end cap 275) to its uppermost portion (in this instance the uppermost end of the mounting bracket 264) is between about 4 and 8 inches.

The seat 22 and the arms 25 (i.e., the frame 23) and the backrest 28 are attached to the rocker assembly 262 via a pair of reclining mechanisms 40. The reclining mechanisms 40 mount the backrest 28 to the frame 23 and move the backrest 28 between an upright position (FIGS. 1 and 4), in which the backrest 28 is generally upright and positioned above the rear portion of the seat 22, and a reclined position (FIGS. 2 and 5), in which the backrest 28 is reclined relative to the upright position (i.e., the backrest 28 takes a shallower angle relative to the underlying surface in the reclined position). The reclining mechanisms 40 are mirror images of one another about the plane P; as such, only one reclining mechanism 40 is described herein, with the understanding that this discussion is equally applicable to the reclining mechanism on the opposite side of the chair 10. Also, the reclining mechanism 40 will be described first with respect to FIGS. 1 and 4, a description of its movement to the reclined position (FIGS. 2 and 5) will then follow.

Figure 4:
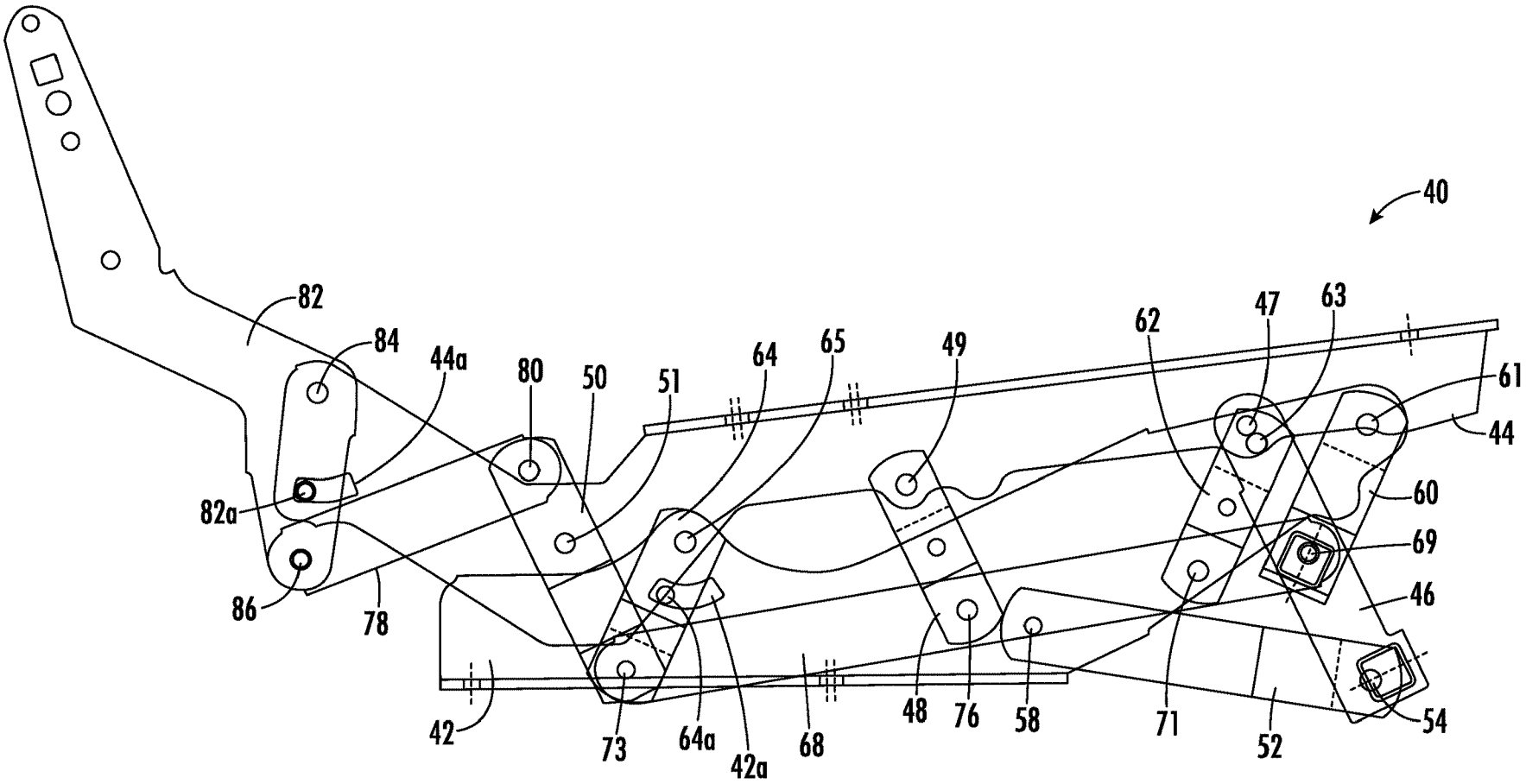
FIG. 4 is a side view of the reclining mechanism of the chair of FIG. 1 shown in the upright position.

Referring now to FIGS. 1 and 4, a foundation link 42 is mounted to the upper surfaces of the cross-members 284*a*, 284*b*. A seat link 44 is mounted to the underside of the seat 22. Front, intermediate, and rear swing links 46, 48, 50 are mounted to the seat link 44 at pivots 47, 49 and 51 respectively, and extend downwardly and forwardly therefrom. A drawing link 52 is mounted to the lower end of the front swing link 46 at a pivot 54 and extends rearwardly therefrom to a pivot 58 with the foundation link 42. Front, intermediate and rear control links 60, 62, 64 are mounted to the foundation link 42 at pivots 61, 63 and 65, respectively and extend downwardly and slightly rearwardly therefrom. The rear control link 64 includes a pin 64*a* that is received in a slot 42*a* in the foundation link 42. A transition link 68 is generally horizontal and is attached to the lower ends of the front, intermediate and rear control links 60, 62, 64 at pivots 69, 71, 73 respectively. The front swing link 46 is attached to the front control link 60 and the transition link 68 at the pivot 69, the intermediate swing link 48 is attached to the transition link 68 at a pivot 76, and the rear swing link 50 is attached to the transition link 68 and the rear control link 64 at the pivot 73. The upper end of the rear swing link 50 is attached to a connecting link 78 at a pivot 80. A backpost 82 is fixed to the backrest 28 and extends forwardly and downwardly therefrom. The backpost 82 is pivotally attached at an intermediate location to the seat link 44 at a pivot 84, and to the rear end of the connecting link 78 at a pivot 86. A pin 82*a* on the backpost 82 is received in a slot 44*a* in the seat link 44.

Referring to FIGS. 1 and 6, an actuating unit 30 includes a motor 31, a sleeve 32 attached to the motor 31 and extending forwardly therefrom, and a rod 33 that retracts within and extends from the sleeve 32. The motor 31 is attached at a pivot 34 to a small bracket 35 that is fixed to the spring base 278. The front end of the rod 33 is attached at a pivot 36 to a bracket 37 that is fixed to the underside of the seat 22.

Figure 5:
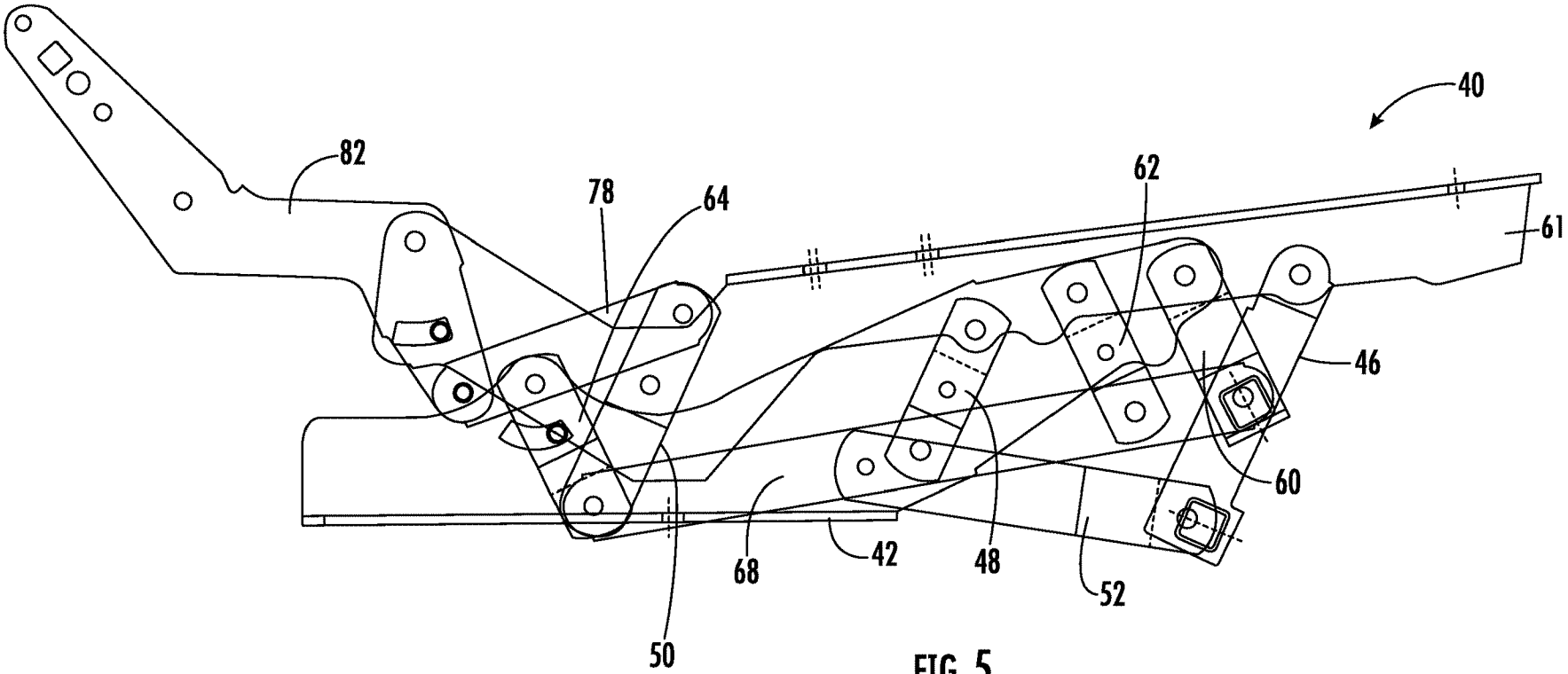
FIG. 5 is a side view of the reclining mechanism of the chair of FIG. 1 shown in the reclined position.

To move the backrest 28 from the upright position of FIGS. 1 and 4 to the reclined position of FIGS. 2 and 5, the occupant of the chair 10 activates the actuating unit 30. Often the actuating unit 30 may be activated via one or more buttons, switches, toggles, or the like that are attached to the chair 10 and within easy reach of the occupant (for example, buttons may be mounted on the inside or outside of one of the arms 25, or mounted as part of a console or handheld remote control device). Such buttons, switches, etc., are operatively connected with the motor 31 (e.g., they may be hard-wired or wireless) to cause the motor 31 to operate. As the motor 31 drives the rod 33 from the sleeve 32, forward movement of the rod 33 pushes the bracket 37, and in turn the seat link 44 and, in fact, the entire frame 23, forwardly. Forward movement of the seat 22 relative to the foundation link 42 causes the upper ends of each of the front, intermediate and rear swing links 46, 48, 50 to move forwardly, such that these links 46, 48, 50 rotate clockwise (from the vantage point of FIGS. 1 and 2) about pivots 47, 49, 51. Rotation of the front swing link 46 also draws the transition link 68 forwardly, which rotates the front, intermediate and rear control links 60, 62, 64 counterclockwise about the pivots 61, 63, 65. Forward movement of the seat 22 exceeds that of the transition link 68. As a result, the clockwise pivoting of the rear swing link 50 draws the connecting link 78 forwardly, which in turn draws the lower end of the backpost 82 forward, thereby rotating the backpost 82 counterclockwise about the pivot 84. Rotation of the backpost 82 ceases when the pin 82*a* reaches the front end of the slot 44*a* and the pin 64*a* reaches the front end of the slot 42*a*.

Figure 7:
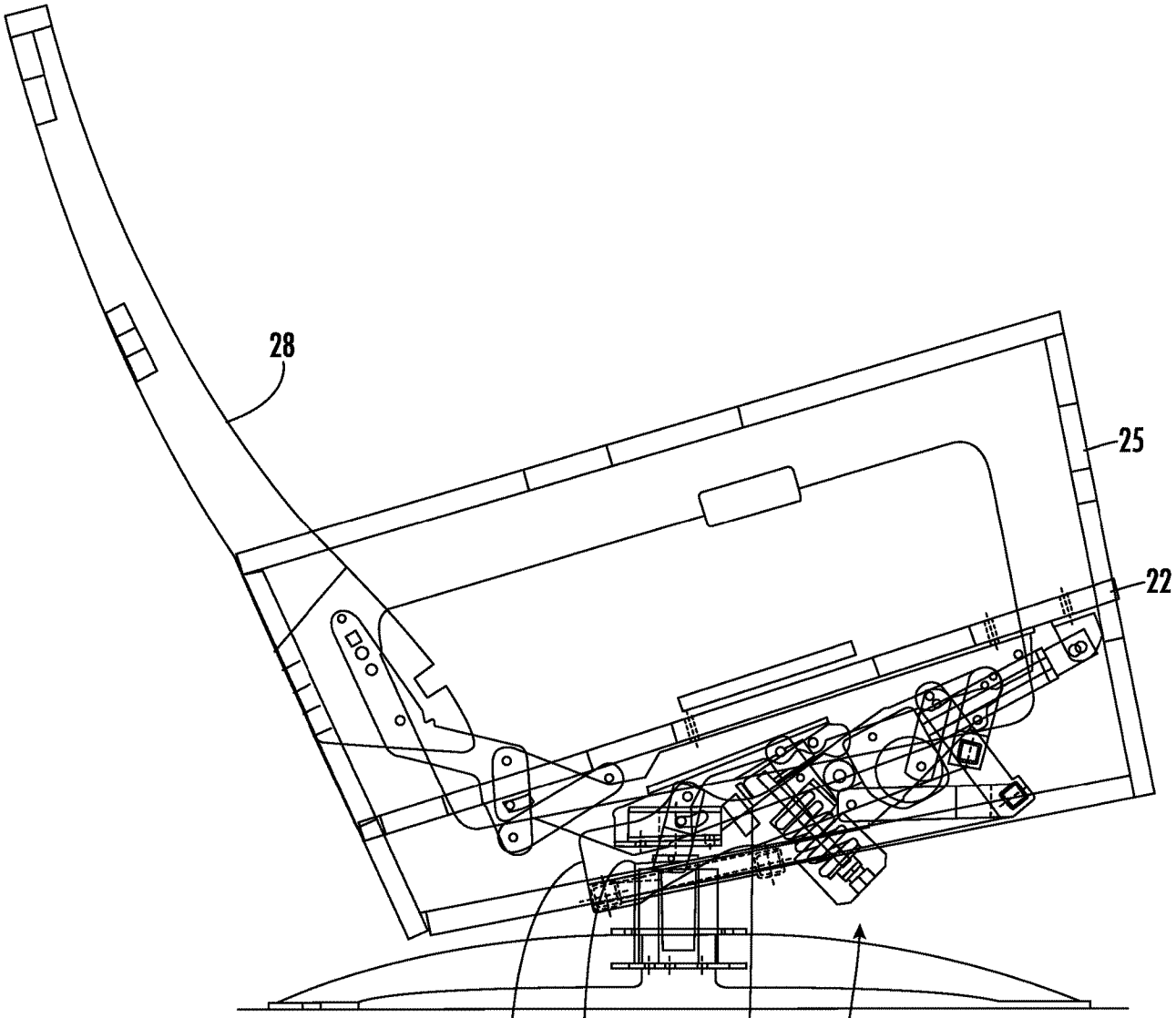
FIGS. 7 and 8 are side views showing how the chair of FIG. 1 can rock in both the upright position (FIG. 7) and the reclined position (FIG. 8).
Figure 8:
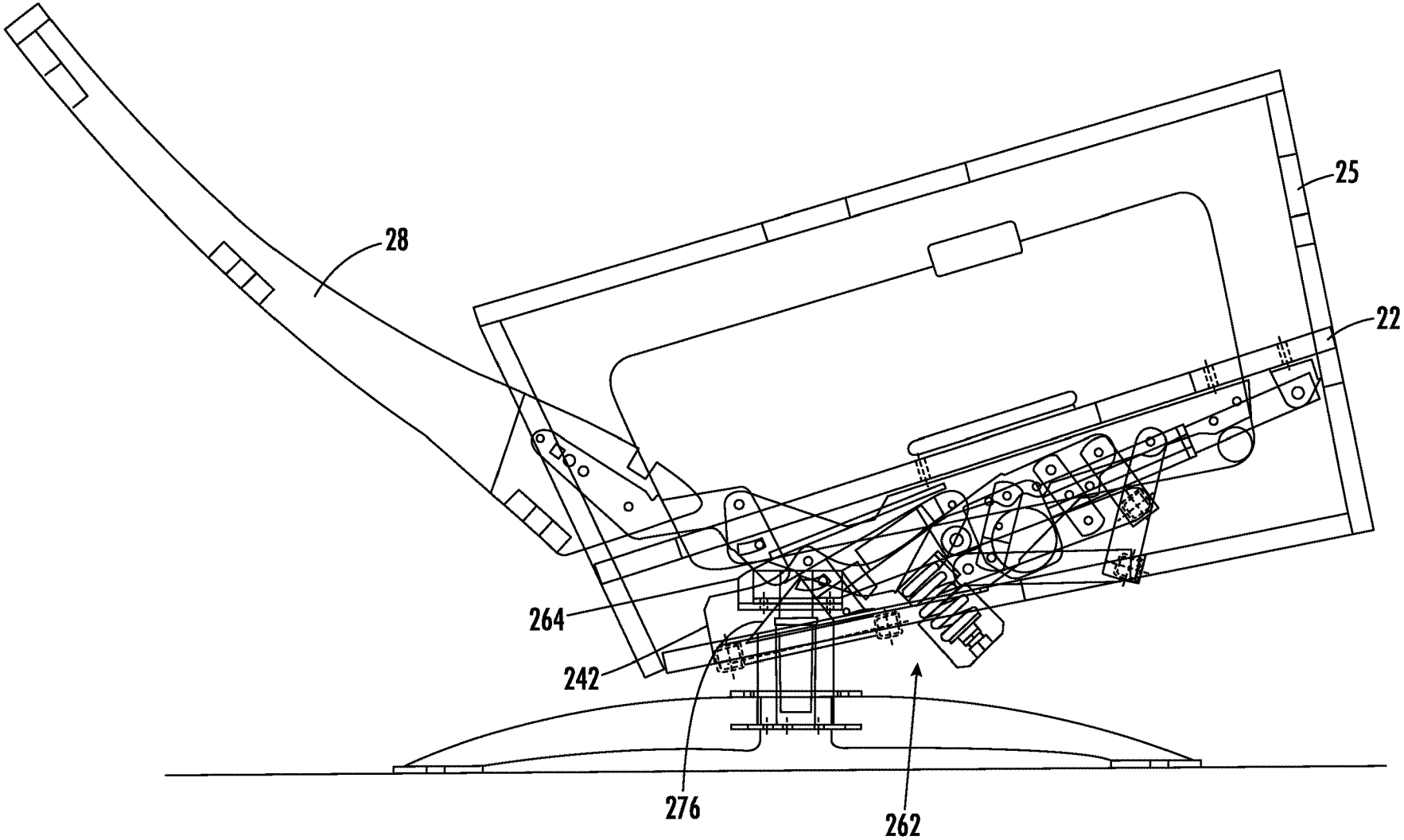

The chair 10 is also free to rock in any of the positions of the backrest 28 relative to the frame 23. As can be seen in FIGS. 7 and 8, the seat 22 and arms 25 are connected to the rocking links 276 via the cross-members 284*a*, 284*b* and the reclining mechanisms 40. The base 12 is fixed to the mounting brackets 264. Because the rocking links 276 are able to pivot relative to the mounting brackets 264 about the pivot 280, the seat 22, arms 25 and backrest 28 are able to rock relative to the base 12. Rocking motion is dampened by the spring 270. As shown in FIG. 3, the spring 270 is confined between the cap 275 and the spring base panel 278. When the chair 10 is unoccupied, or when the occupant is leanig or rocking forward, the spring 270 biases the spring base panel 278, and in turn the rocking links 276, upwardly, such that the arms 25 and seat 22 are "rocked" forwardly, with the rear of the seat 22 in its most elevated position. In this position, the rocking link 276 is oriented such that the pin 264*a* is located in the bottom end of the slot 276*a*.

As the occupant rocks the chair 10 rearwardly (FIGS. 7 and 8), the rocking links 276 pivot counterclockwise relative to the mounting brackets 264 about the pivot 280. When this occurs, the spring base panel 278 is lowered and compresses the spring 270 against the cap 275. The distance between the cap 275 and the cross-member 266 is essentially constant due to the presence of the rod 272, although the rod 272 is free to pivot about the pivot 274. Compression of the spring 270 dampens the rocking motion and urges the chair 10 to return to its forward position. The maximum stroke of the rocking motion is controlled by the pin 264*a* on the mounting bracket 264 reaching the upper end of the slot 276*a* in the rocking link 276.

The foregoing demonstrates that the chair 10 provides flexibility to the occupant; he can recline the backrest 28, allow the backrest 28 to remain upright, or partially recline the backrest 28 to a position between the upright and reclined positions. In any of these positions, the occupant is free to rock while occupying the chair 10. Because the seat 22 moves forwardly relative to the arm frame 25 when the backrest 28 reclines, the center of gravity of the chair 10 and the occupant move forward relative to the base 12, such that the chair 10 resists tipping over backward when the backrest 28 is reclined with an occupant present, even when the backrest 28 is fully reclined. In some embodiments, the seat 22 (and, in turn, the entire frame 23) moves forwardly relative to the base 12 at least about 3 inches, and in some embodiments between about 3 and 5 inches, when moving from the upright position to the reclined position. The forward movement of the seat 22 (and the resultant shifting of the center of gravity of the chair 10) can enable different styles of bases to be used (e.g., sleeker, modern bases with smaller "footprints" that some modern consumers prefer).

In addition, the position of the pivot 280 between the rocking link 276 and the mounting bracket 264 (i.e., considerably forward of the spindle 256 of the swivel unit 253) can provide a somewhat different, and in many cases more pleasant, rocking motion to the chair 10. In a conventional rocker-recliner that employs cams that rock relative to the floor and springs that control/dampen the rocking motion, the pivot point for rocking motion of the chair is much farther from the front of the chair, which results in a rocking motion that lowers the rear of the seat as the occupant rocks rearwardly and lowers the front of the seat as the occupant rocks forwardly. This type of motion can be somewhat uncomfortable if the occupant has his feet on the floor, and in some instances the occupant can experience the uncomfortable feeling of being "flung" forwardly. In contrast, the motion of the chair 10 is primarily limited to the rear portion of the seat 22 lowering and rising during the rocking motion, because the pivot 280 is positioned relatively near the front of the seat 22 (typically between about 8 and 12 inches), the forward portion of the seat drops very little, if at all, during the rocking motion, and considerably less than the rearmost portion of the seat 22. Consequently, the motion can be more comfortable for an occupant who is sitting with his feet on the floor, and there is little to no sensation of being "flung" forwardly. In this sense, the "rocking" motion is somewhat like that provided by an office chair.

It should also be noted that the dampening influence of the spring unit 268 can be adjusted. Because the end cap 275 is threaded on the rod 272, rotation of the end cap 275 relative to the rod 272 moves the position of the end cap 275 relative to the spring base 278, thereby adjusting the degree of compression in the spring 270. As such, dampening effect of the spring unit 268 on the rocking motion of the chair 10 can be increased by tightening the end cap 275 and decreased by loosening the end cap 275.

Further, the inclusion of the intermediate swing link 48 and/or the intermediate control link 62 can improve performance. It was discovered that, in view of tolerances often used in reclining mechanism links, without the intermediate swing link 48 and the intermediate control link 62, the chair 10 tended to have a somewhat choppy path when rocking. By including the intermediate swing link 48, and doing so with a very slightly shorter distance between the holes for the pivots 49, 76 compared to the distance between the holes for the pivots 47, 69 and the pivots 51, 73, the intermediate swing link 48 tends to maintain the reclining mechanism 30 in a tight configuration that does not experience the somewhat choppy path described above. Similarly, the inclusion of the intermediate control link 62 with holes for the pivots 63, 71 that are very slightly closer together than the holes for the pivots 61, 69 and the pivots 65, 73 can have a similar "lightening" effect.

Referring now to FIGS. 9-16, another chair, designated broadly at 310, is shown therein. The chair 310 has a base 312, arms 325 that are fixed to a seat 322 to form a frame 323, and a backrest 328 that are similar to those described for the chair 10. However, rather than a rocking mechanism, the chair 310 has a gliding mechanism 460, and also includes a modified reclining mechanism 340 and a slightly modified actuating unit 330. These are described below.

Figure 12:
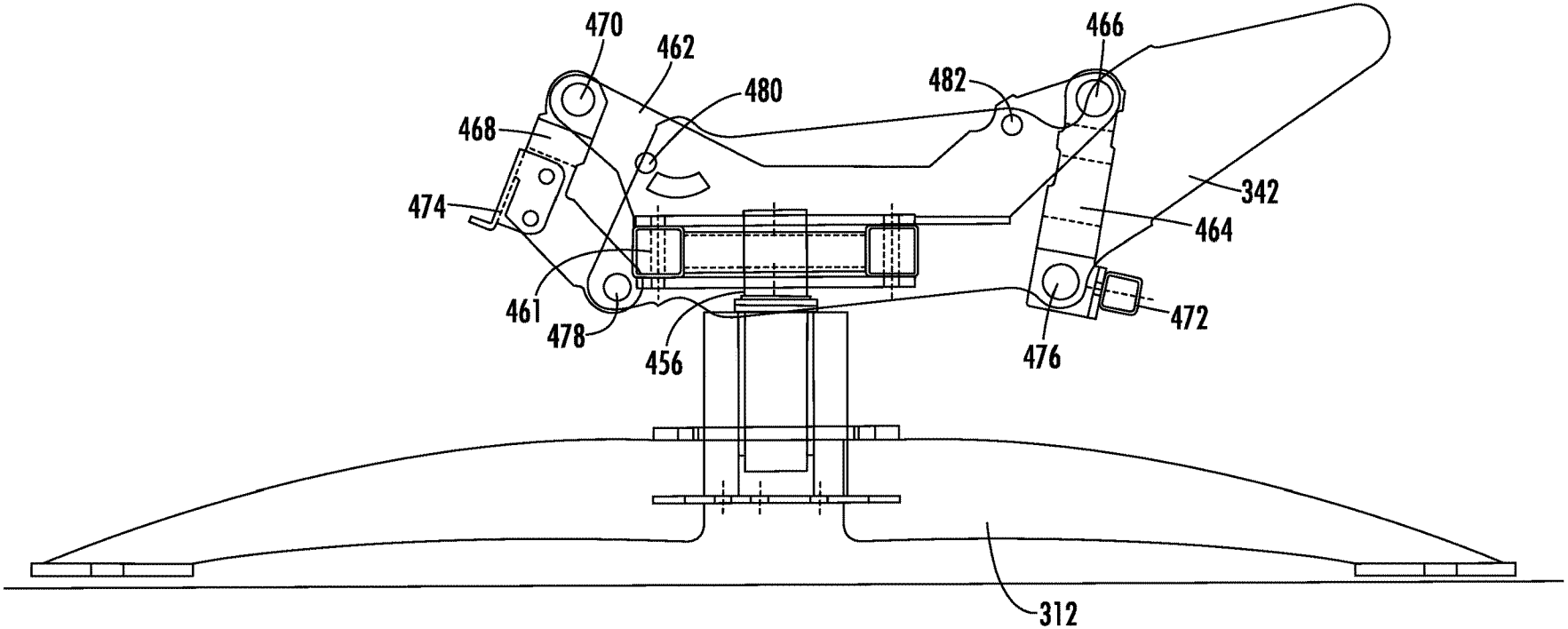
FIG. 12 is a side view of the gliding assembly of the chair of FIG. 9.
Figure 13:
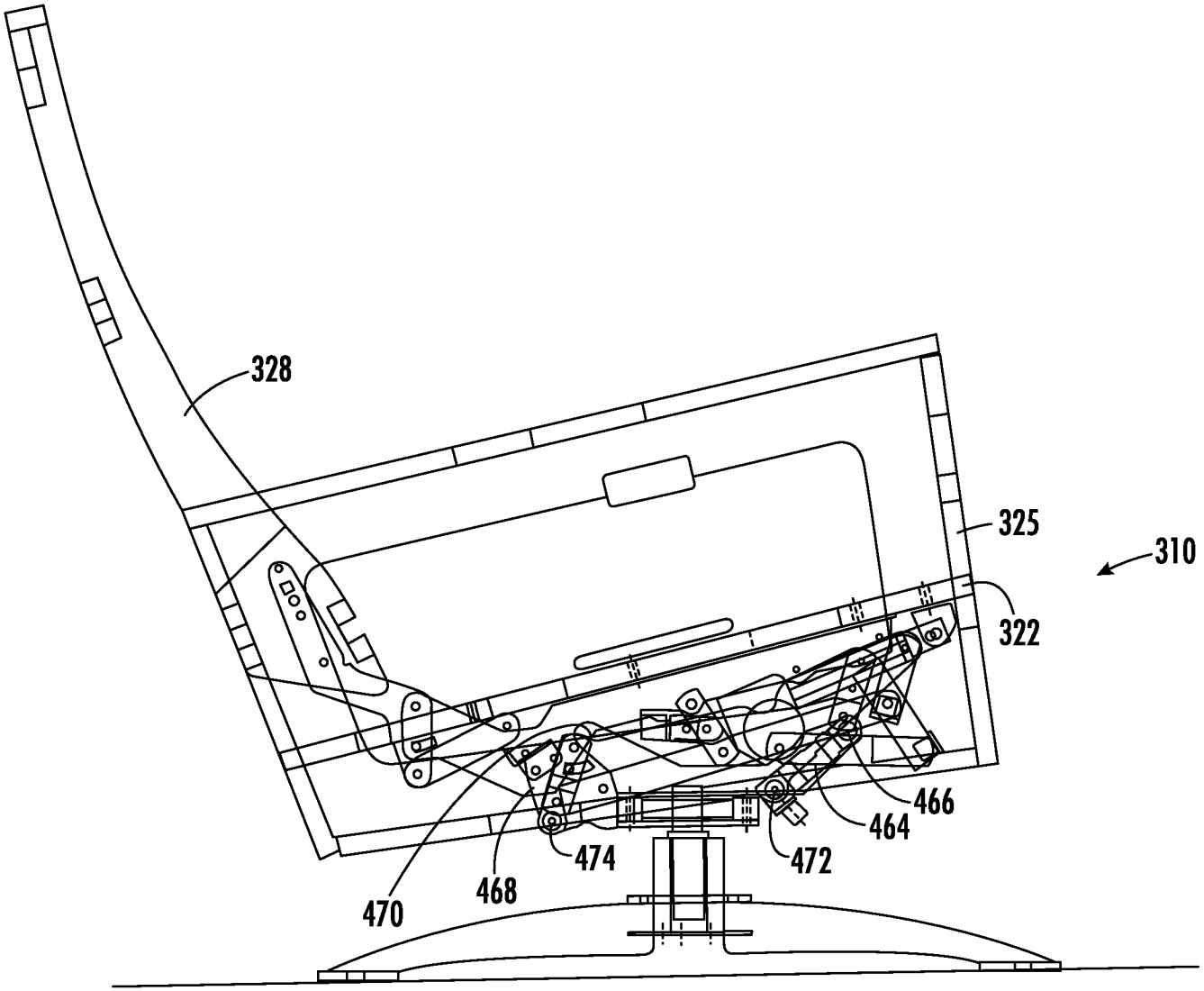
FIGS. 13-16 are side views showing how the chair of FIG. 9 can glide rearwardly (FIGS. 13 and 15) and forwardly (FIGS. 14 and 16) in both the upright position (FIGS. 13 and 14) and the reclined position (FIGS. 15 and 16).
Figure 14:
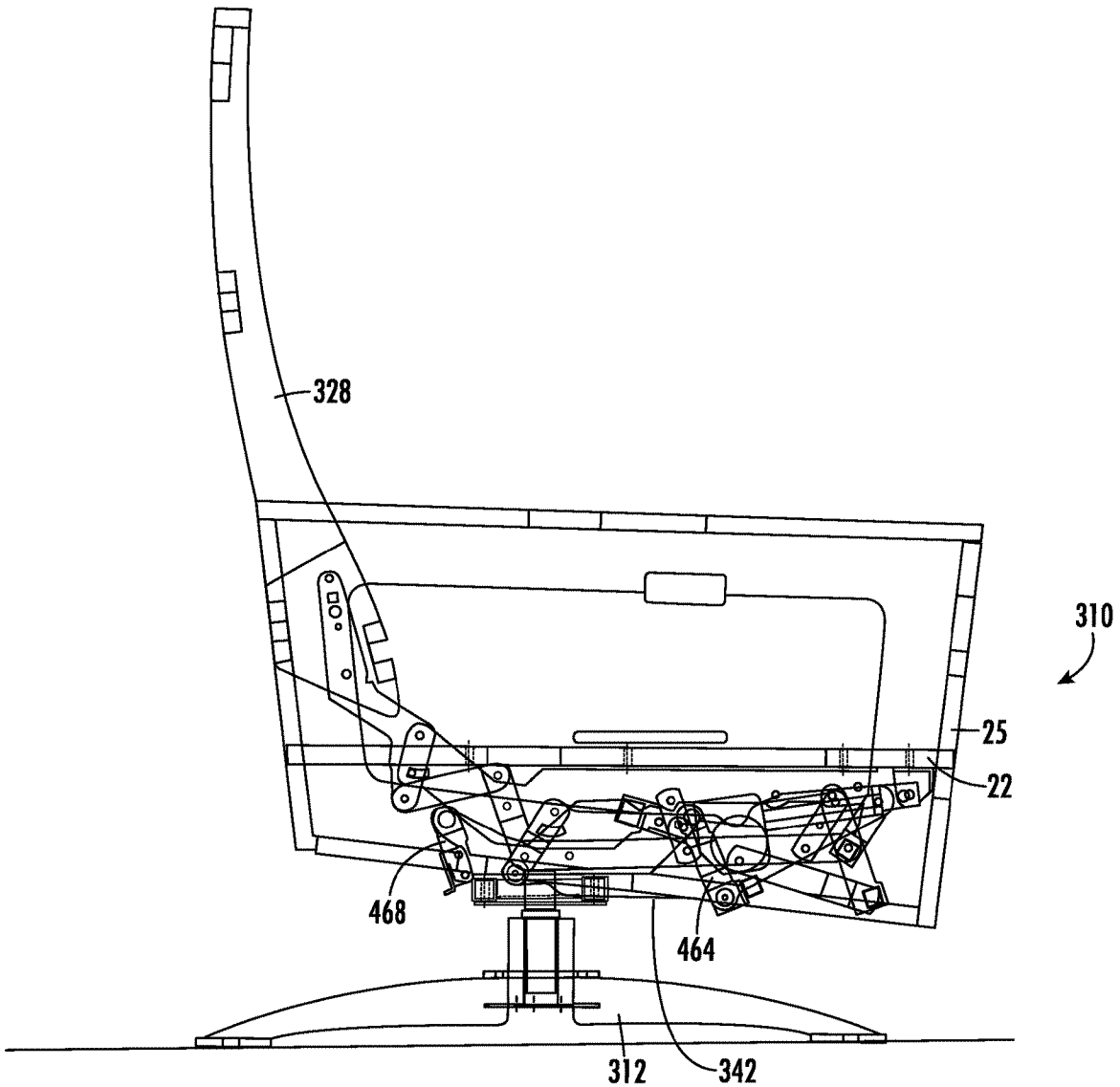
Figure 15:
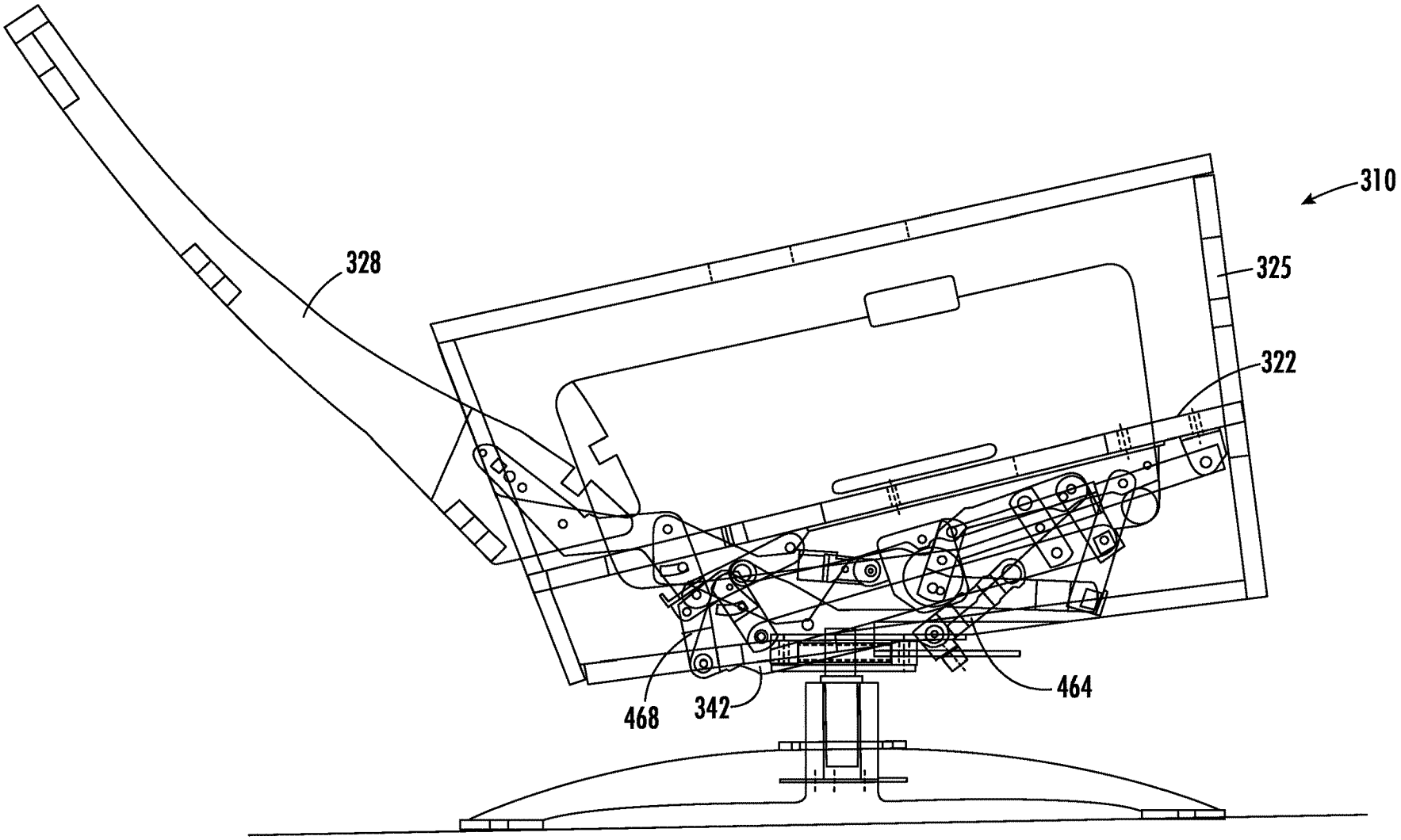
Figure 16:
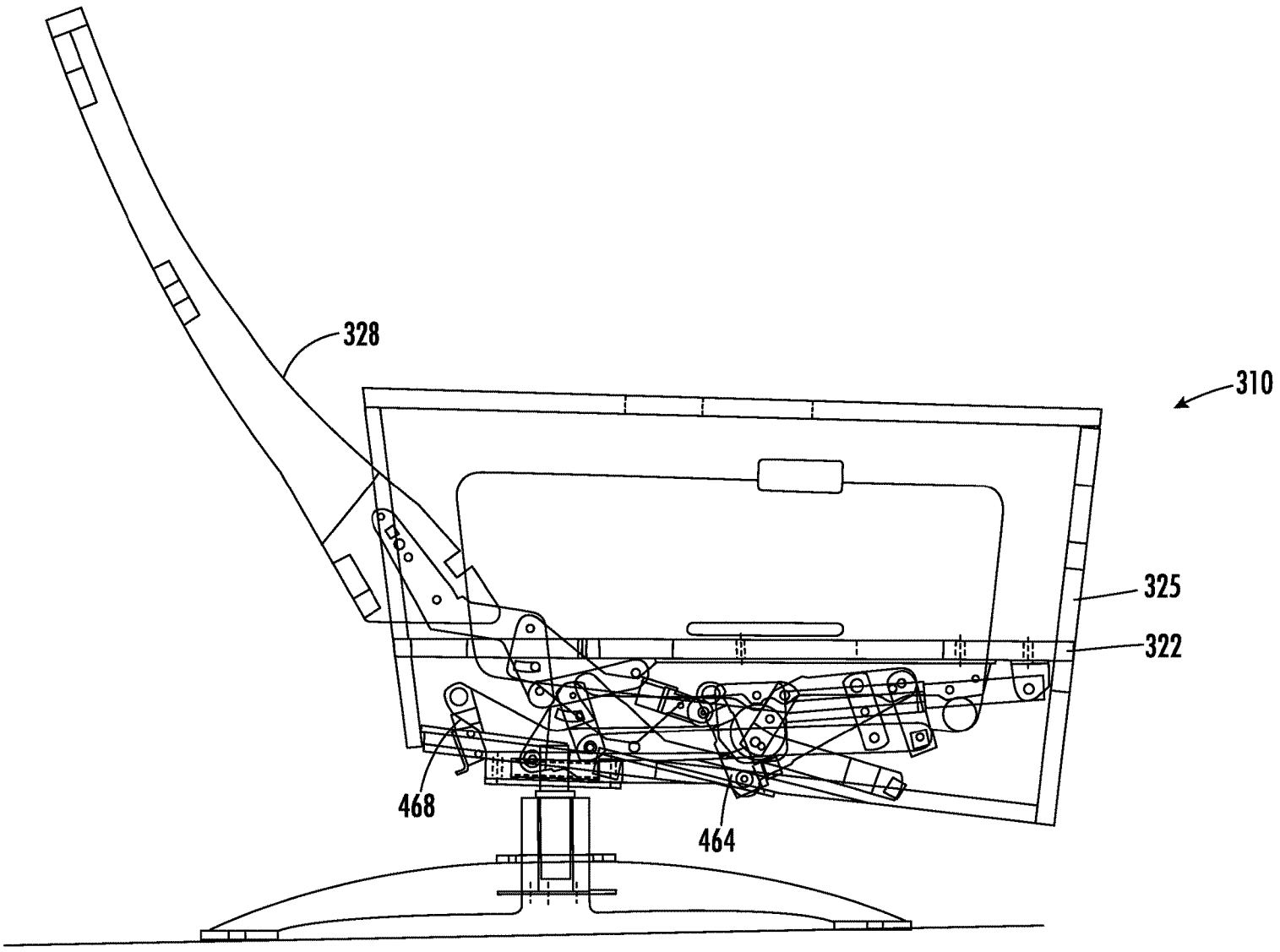

Referring to FIG. 12, the gliding mechanism 460 includes a glide base plate 462 that is mounted on a chassis 461 that is attached to the spindle 456 of the base 312. A front glide link 464 is mounted to a front portion of the glide base plate 462 at a pivot 466. A rear glide link 468 is mounted to a rear portion of the glide base plate 462 at a pivot 470. Each of the front and rear glide links 464, 468 is braced to its corresponding glide link 464, 468 on the opposite side of the chair 310 by a respective cross-member 472, 474. At its lower end, the front glide link 464 is attached to the foundation link 342 of the reclining mechanism 340 at a pivot 476. The rear glide link 468 is attached to the foundation link 342 at a pivot 478.

In this configuration, the foundation link 342 (and in turn the reclining mechanisms 340, the frame 323, and the backrest 328) are free to glide along the path defined by the front and rear glide links 464, 468 as they are suspended from the glide base plate 462. The glide path is limited in the forward direction by a stop pin 480 mounted on the glide base plate 462 that engages the front edge of the rear glide link 468 (see FIGS. 14 and 16), and in the rearward direction by a stop pin 482 that engages the rear edge of the front glide link 464 (see FIGS. 13 and 15).

Figure 9:
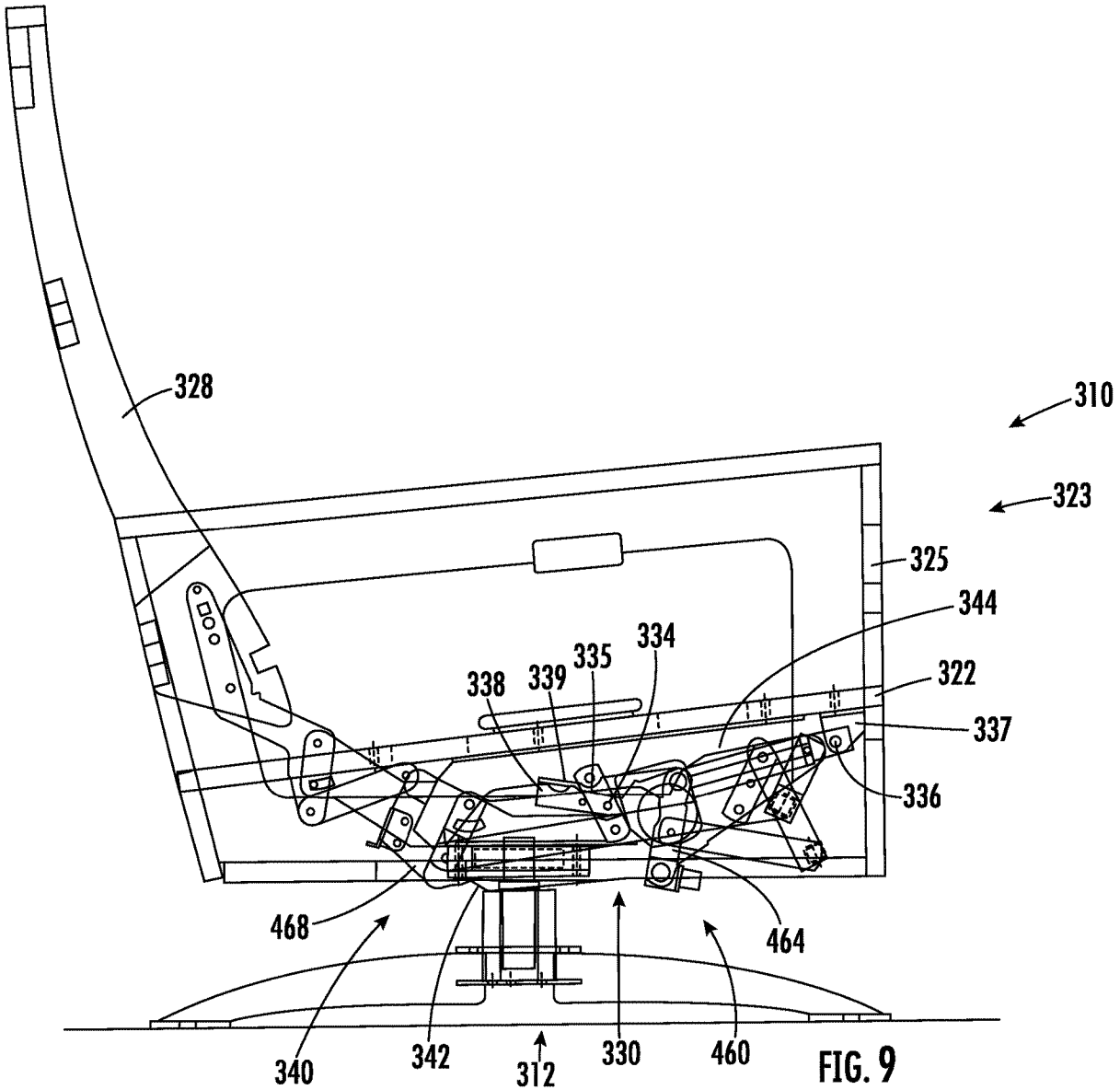
FIG. 9 is a side section view of a gliding-reclining chair according to embodiments of the invention, with the chair shown in the upright position.
Figure 10:
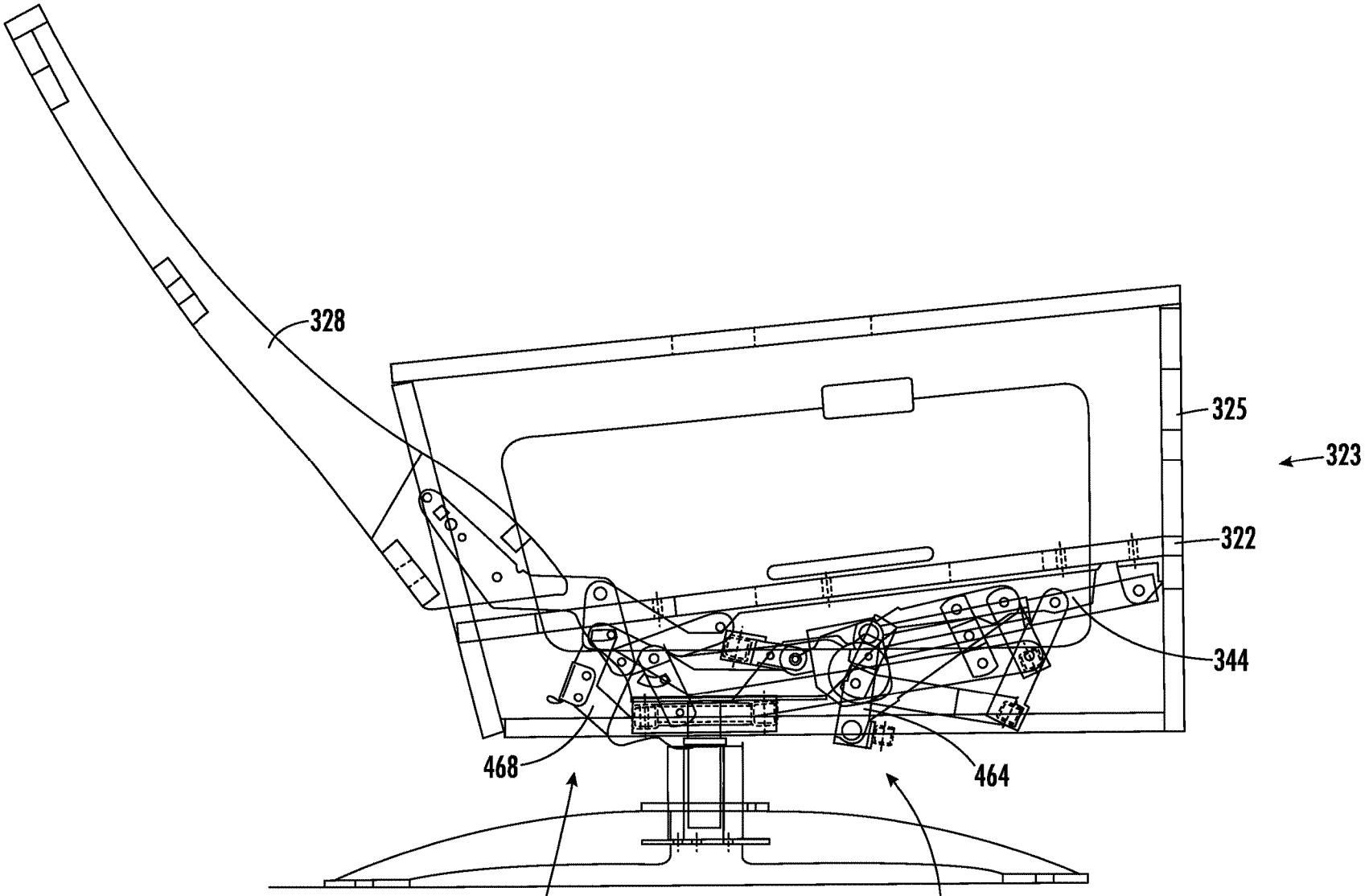
FIG. 10 is a side section view of the chair of FIG. 9, with the chair shown in the reclined position.
Figure 11:
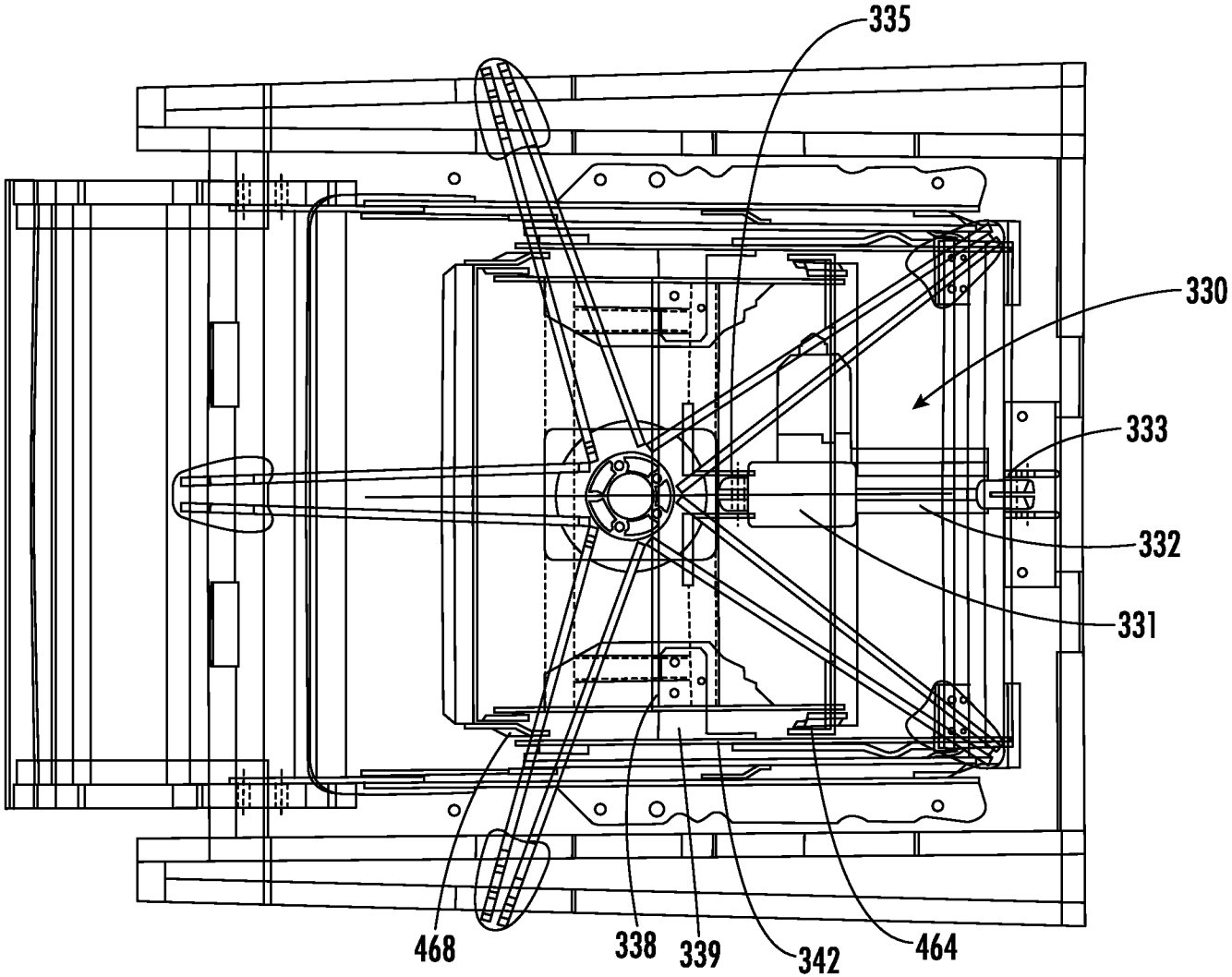
FIG. 11 is a top section view of the chair of FIG. 9.

Like the actuating unit 30, the actuating unit 330 includes a motor 331, a sleeve 332 attached to the motor 331 and extending forwardly therefrom, and a rod 333 that retracts within and extends from the sleeve 332 (see FIGS. 9 and 11). The motor 331 is attached at a pivot 334 to a small bracket 335 that is fixed to a cross-member 338 that extends between the foundation plates 342 of the reclining mechanism 340 and is mounted via a bracket 339. The front end of the rod 333 is attached at a pivot 336 to a bracket 337 that is fixed to the underside of the seat 322.

To move the chair from the upright position (FIGS. 9, 13 and 14) to the reclined position (FIGS. 10, 15 and 16), the occupant activates the actuating unit 330 as described above in connection with the actuating unit 30. Extension of the rod 333 from the sleeve 332 forces the seat 322 and seat link 344 forward. The remaining links of the reclining mechanism 340 move in the same manner described above for the reclining mechanism 40.

Also, as discussed above in connection with the chair 10, significant forward movement of the frame 323 relative to the base 312 in moving to the reclined position (again, the frame 323 may move between about 3 and 5 inches forwardly relative to the base 312) moves the center of gravity of the chair 310 (and the occupant when the chair 310 is occupied) forward. As such, the chair 310 is configured to avoid tipping, even in the reclined position when the occupant is gliding.

Those of skill in this art will appreciate that, although the rocking unit 262 and gliding unit 460 are shown herein, other types of mechanisms that provide a fore-and-aft reciprocating movement may also be employed.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A reciprocating seating unit, comprising:

a base configured to rest on an underlying surface;

a frame comprising a generally horizontal seat and opposed arms on opposite sides of the seat, a backrest;

a reciprocating unit attached to the base, the reciprocating unit configured to permit reciprocating longitudinal movement of the frame and backrest relative to the base;

and a reclining mechanism attached to the reciprocating unit, the frame and the backrest, the reclining mechanism comprising a plurality of pivotally interconnected links and configured to move the backrest between an upright position, in which the backrest takes a first backrest angle relative to the underlying surface and the frame is positioned relative to the base in a first location, and a reclining position, in which the backrest takes a second backrest angle relative to the underlying surface that is shallower than the first backrest angle, and the frame is positioned relative to the base in a second location that is at least 3 inches in front of the first location;

wherein the frame and backrest are free to reciprocate in the upright position and in the reclined position.

2. The seating unit defined in claim 1, wherein the reciprocating unit is a gliding unit.

3. The seating unit defined in claim 1, wherein the reclining mechanism comprises:

a foundation link attached to the reciprocating unit;

a seat link fixed to the seat;

front and rear swing links pivotally attached to the seat link, front and rear control links pivotally attached to the foundation link.

4. The seating unit defined in claim 3, wherein the reclining mechanism further comprises a transition link, and wherein each of the front swing link, the rear swing link, the front control link, and the rear control link is pivotally attached to the transition link.

5. The seating unit defined in claim 4, wherein the reclining mechanism further comprises an intermediate swing link that is pivotally attached to the seat link and to the transition link.

6. The seating unit defined in claim 4, wherein the reclining mechanism further comprises an intermediate control link that is pivotally attached to the foundation link and to the transition link.

7. The seating unit defined in claim 4, wherein the reclining mechanism further comprises a drawing link that is pivotally attached to the front swing link and to the foundation link.

8. The seating unit defined in claim 4, wherein the reclining mechanism further comprises a backpost that is fixed to the backrest and is pivotally attached to the seat link, and comprises a connecting link that is pivotally attached to the backrest and to the rear swing link.

9. The seating unit defined in claim 1, wherein the second location is between about 3 and 5 inches forwardly of the first location.

10. The seating unit defined in claim 1, further comprising an actuating unit attached to the reciprocating unit and to the seat.

11. The seating unit defined in claim 10, wherein the actuating unit comprises a power linear actuator.

12. The seating unit defined in claim 1, wherein the arms are fixed relative to the seat.

13. A reciprocating seating unit, comprising:

a base configured to rest on an underlying surface;

a frame comprising a generally horizontal seat and opposed arms on opposite sides of the seat;

a backrest;

a reciprocating unit attached to the base, the reciprocating unit configured to permit reciprocating longitudinal movement of the frame and backrest relative to the base;

and a reclining mechanism attached to the reciprocating unit, the frame and the backrest, the reclining mechanism comprising a plurality of pivotally interconnected links and configured to move the backrest between an upright position, in which the backrest takes a first backrest angle relative to the underlying surface and the frame is positioned relative to the base in a first location, and a reclining position, in which the backrest takes a second backrest angle relative to the underlying surface that is shallower than the first backrest angle, and the frame is positioned relative to the base in a second location that is at least 3 inches in front of the first location;

further comprising a linear actuating unit attached to the reciprocating unit and to the seat.

14. A reciprocating seating unit, comprising:

a base configured to rest on an underlying surface;

a frame comprising a generally horizontal seat and opposed arms on opposite sides of the seat;

a backrest;

a reciprocating unit attached to the base, the reciprocating unit configured to permit reciprocating longitudinal movement of the frame and backrest relative to the base; and a reclining mechanism attached to the reciprocating unit, the frame and the backrest, the reclining mechanism comprising a plurality of pivotally interconnected links and configured to move the backrest between an upright position, in which the backrest takes a first backrest angle relative to the underlying surface and the frame is positioned relative to the base in a first location, and a reclining position, in which the backrest takes a second backrest angle relative to the underlying surface that is shallower than the first backrest angle, and the frame is positioned relative to the base in a second location that is at least 3 inches in front of the first location;

wherein the arms are fixed relative to the seat.

* * * * *